US006029592A

United States Patent [19]

Tsuta

[11] Patent Number: 6,029,592

[45] Date of Patent: Feb. 29, 2000

[54] CLOTH FOLDING GUIDE FOR SEWING MACHINE

[76] Inventor: Shigeharu Tsuta, 2-5-27, Joto-ku, Osaka, Japan

[21] Appl. No.: 09/218,224

[22] Filed: Dec. 22, 1998

[51] Int. Cl.[7] ..... D05B 35/06

[52] U.S. Cl. ..... 112/137; 112/152

[58] Field of Search ..... 112/147, 148, 112/149, 137, 152, 153, 418, 475.06

[56] References Cited

U.S. PATENT DOCUMENTS

| | | | |
|---|---|---|---|
| 2,096,330 | 10/1937 | Vesconte | 112/147 |
| 2,977,904 | 4/1961 | Carmen | 112/147 X |
| 3,064,601 | 11/1962 | Dargols | 112/137 |
| 5,199,364 | 4/1993 | Conte et al. | 112/137 X |

*Primary Examiner*—Ismael Izaguirre
*Attorney, Agent, or Firm*—Moonray Kojima

[57] ABSTRACT

The present invention, which is a cloth folding guide for sewing machine for guiding a belt-shaped cloth to fold it into a state in which the edge of the cloth body is covered, is realized in a way to insert a control member in the folding passage of the cloth folding unit constituting the cloth folding guide and either prevent folding of the edge of cloth or cancel that prevention of folding, making it possible to sew the cloth into a state in which the edge of the cloth body is covered, while folding the cloth in an optional state of folding (quadruple folding, triple folding, double folding) with a single cloth folding guide 1. In addition, a tentering member is inserted in the flat cylindrical passage in the flat part of the cloth, to guide and fold the cloth at optional width by preventing the cloth from being swung in the direction of breadth.

6 Claims, 12 Drawing Sheets

CLOTH FOLDING GUIDE FOR SEWING MACHINE

BACKGROUND OF THE INVENTION

1. Field of the Invention

The present invention relates to a cloth folding guide for sewing machine used for guiding a belt-shaped cloth to fold it into a state in which the edge of the cloth body is covered, in the sewing by sewing machine, for example.

2. Description of the Prior Art

Conventionally, a folding guide for double folding, triple folding or quadruple folding is used for guiding above-mentioned cloth for folding. However, it presents such problems that the guide must be replaced with an optional one each time when the way of folding of the cloth is changed and it takes much time for this replacement work and, moreover, the larger the number of times of replacement of folding guide, the smaller the number of pieces of sewn article per unit time because the sewing work is temporarily interrupted until the replacement work is completed, hence poor working efficiency.

Furthermore, it is also necessary to manufacture or prepare a plurality of folding guides in advance, depending on the way of folding of the cloth, making the handling and management of folding guides rather troublesome. Another problem is that the sewing cost becomes higher as the number of kinds and pieces of the folding guides used at the time of folding of cloth increases.

SUMMARY OF THE INVENTION

The main object of the present invention is to provide a cloth folding guide for sewing machine capable of folding the cloth in an optional state of folding (double folding, triple folding, quadruple folding, for example), by either preventing the edge on one side or the edge on both sides of the cloth from being folded in the direction of breadth with a folding preventing means, or releasing that prevention of folding.

Another object of the present invention is to provide a cloth folding guide for sewing machine capable of folding the cloth at desired width, by guiding tentering of the entire cloth with a folding width changing means, and preventing the cloth from being folded either too wide or too narrow at the edge on folded side or swung in the direction of breadth.

Still another object of the present invention is to provide a cloth folding guide for sewing machine capable of folding the edge on one side or the edge on both sides of the cloth and changing that state of folding, by putting the edge on one side of the cloth in contact with a control member and preventing folding of that part, while folding the edge on the other side for which such contact is avoided.

Yet another object of the present invention is to provide a cloth folding guide for sewing machine capable of changing the width of folding of the cloth with simple movement of tentering member to optional position, by putting the edge of the cloth in contact with a tentering member, thus tentering the entire cloth and folding the edge on folded side of the cloth at an optional width.

A further object of the present invention is to provide a cloth folding guide for sewing machine capable of executing covering of the cloth smoothly, by moving the cloth folding unit in either horizontal direction (to left and right, forward and backward, for example) or vertical direction (up and down, for example), etc., thus variably adjusting the cloth to any optional height and position suitable for the covering.

Still further object of the present invention is to provide a cloth folding guide for sewing machine capable of executing covering of the cloth smoothly, by turning the cloth folding unit in either up-down direction or left-right direction, etc., thus variably adjusting the cloth to any optional angle suitable for the covering.

Yet further object of the present invention will become clear with the description of the embodiment to be presented hereafter.

DESCRIPTION OF THE PREFERRED EMBODIMENT

An embodiment of the present invention will be described in detail hereafter by referring to drawings.

Figure 1:
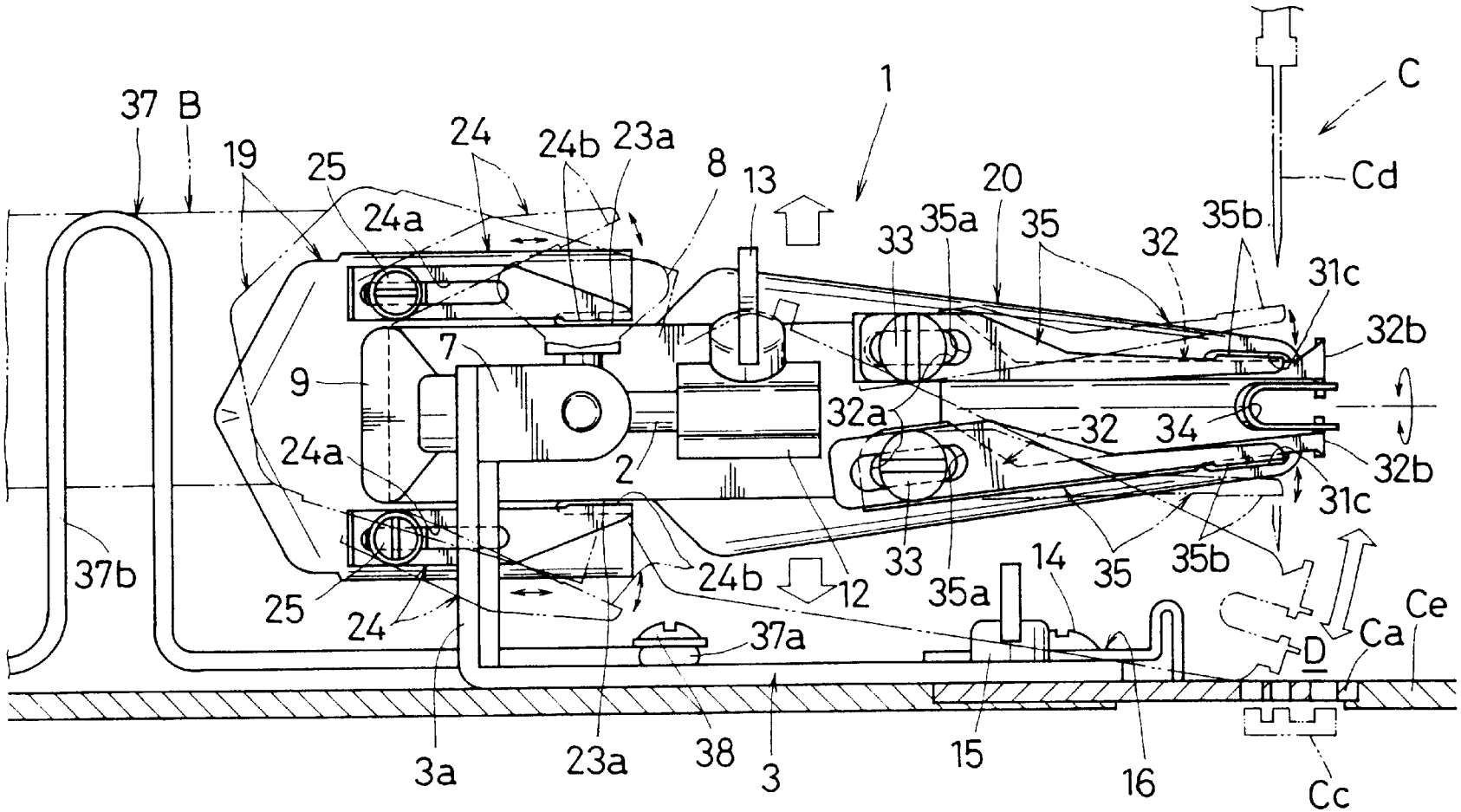
FIG. 1 is a rear view showing the mounted state of a cloth folding guide (according to the present invention).

FIG. 1 indicates a cloth folding guide 1 for sewing machine used for guiding a belt-shaped cloth B to fold it into a state in which the edge Aa of the cloth body A is covered, in the sewing by sewing machine C, mounted at an edge of the needle plate Ca constituting the sewing machine C in a way to be about orthogonal to an edge Aa of the cloth body A fed to the sewing position D set on the needle plate Ca, to guide the belt-shaped cloth B formed at optional width (approx. 18 mm, approx. 24 mm, approx. 28 mm, for example) for folding it in the direction of breadth.

The cloth body A and the cloth B are composed of either simple material or composite material of chemical fiber, natural fiber, etc.

Figure 2:
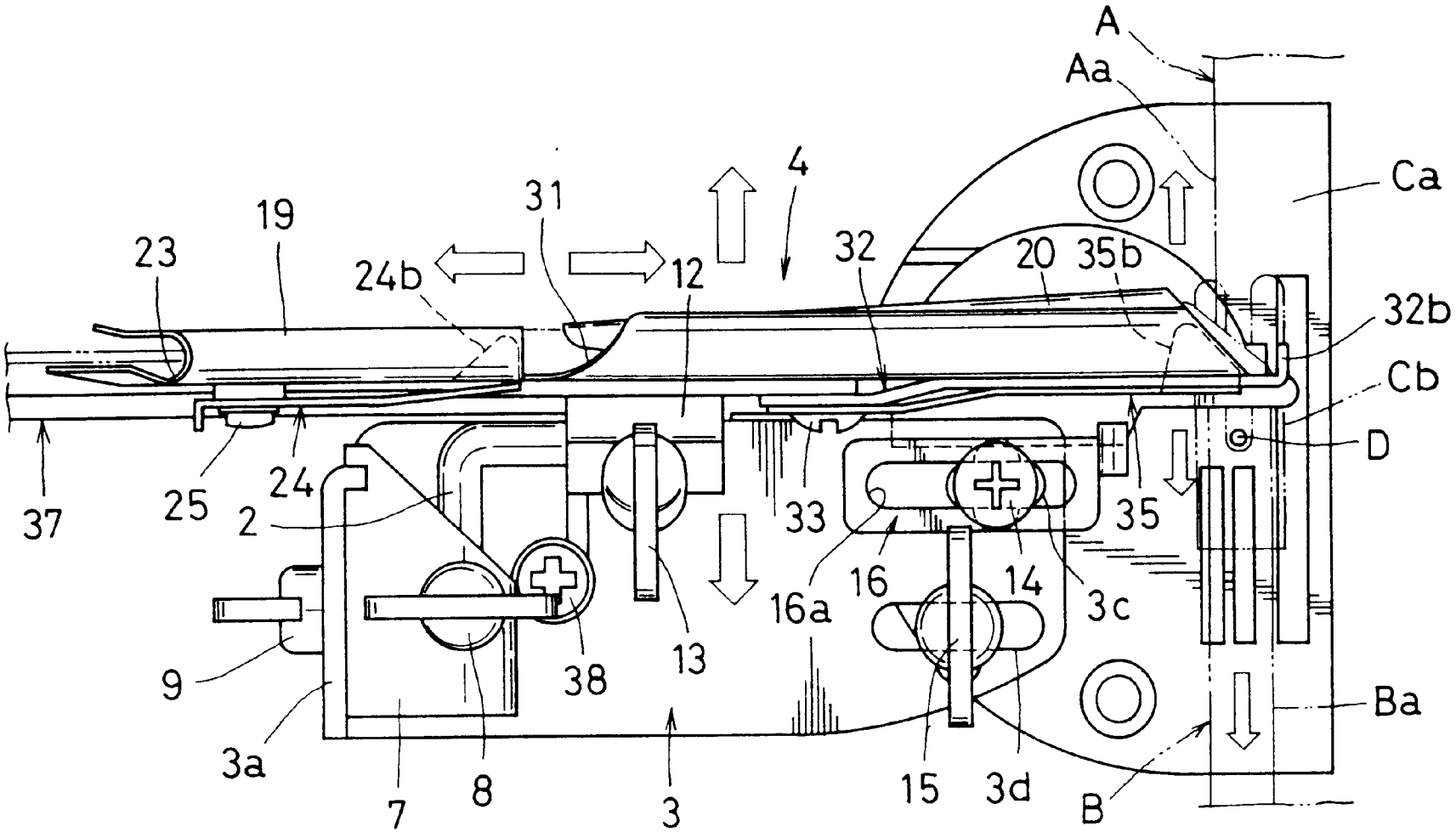
FIG. 2 is a plan view showing the mounted state of the cloth folding guide.
Figure 3:
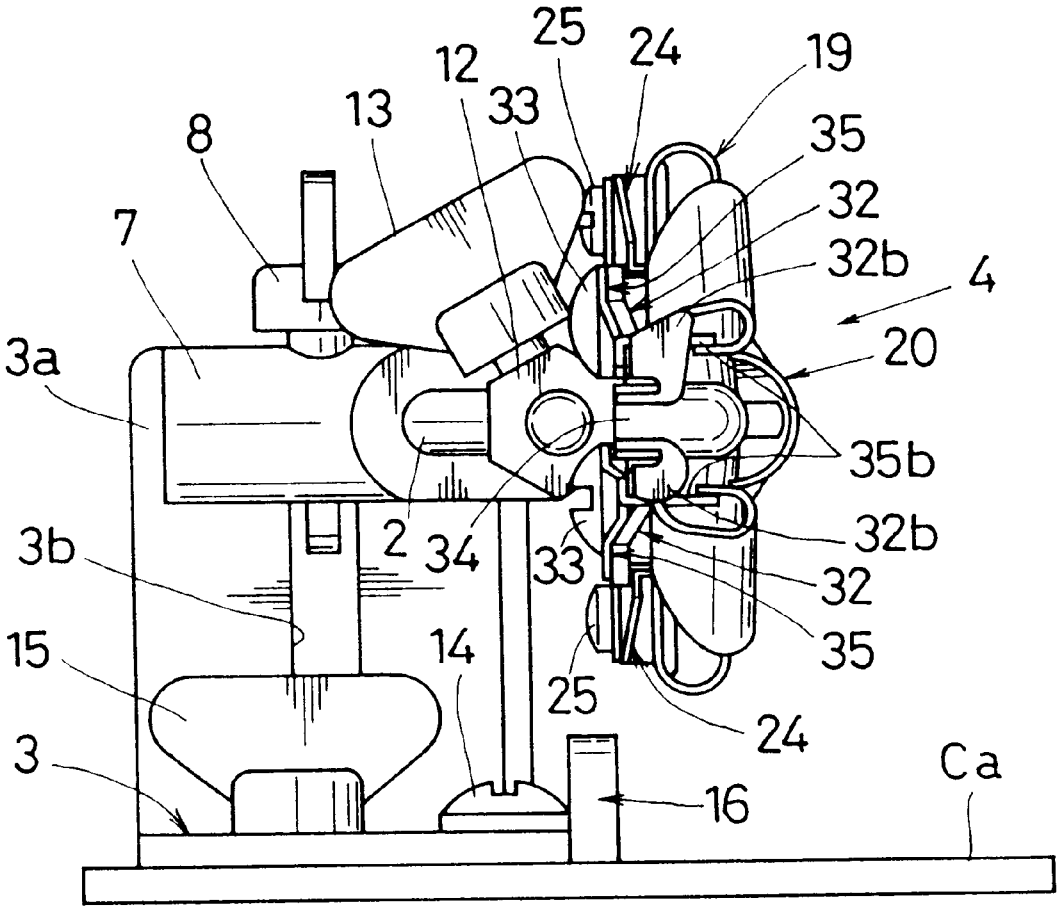
FIG. 3 is a side view showing the state seen from the tip side of the cloth folding guide.

Said cloth folding guide 1 integrally connects, as also shown in FIG. 2 and FIG. 3, a mounting plate 3 and a guide body 4 by means of a supporting shaft 2 formed about in the shape of the character L.

One end side of the supporting shaft 2 is borne by a bearing member 7 in a way to be freely turnable and movable to left and right. The bearing member 7 is mounted, in a way to be movable up and down, to the front face side of the supporting portion 3*a* provided upright on the read end side of the mounting plate 3.

The screw 8 fastened to the top face side of the bearing member 7 is put in contact, in the direction of diameter, with the circumferential face on one end side of the supporting shaft 2, and fixes one end of the supporting shaft 2, with that contact force, in a way to prohibit turning or moving.

The fastening of the screw 8 is released, to either turn the guide body 4 up and down at optional angle around one end side of the supporting shaft 2 or horizontally move it in the direction parallel to the edge Aa of the cloth body A fed to the sewing position D.

The screw 9 fastened to the rear face side of the bearing member 7 is connected, in a way to be turnable up and down, to the guide hole 3*b* formed in the supporting portion 3*a*, and fixes the bearing member 7 to the front face side of the supporting portion 3*a*, in a way to prohibit up-down movement.

The fastening of the screw 9 is released, to move the guide body 4 up and down at optional height along the guide hole 3*b* of the supporting portion 3*a*.

On the other hand, the other end side of the supporting shaft 2 is borne by a bearing member 12, fixed to the central part on the rear face side of the guide body 4, in a way to be freely turnable and movable forward and backward.

The screw 13, fastened to the top face side of the bearing member 12, is put in contact, in the direction of diameter, with the circumferential face on the other end side of the supporting shaft 2, and fixes the other end side of the supporting shaft 2, with that contact force, in a way to prohibit turning or moving.

The fastening of the screw 13 is released, to either turn the guide body 4 to left and right at optional angle around the shaft center on the other end side of the supporting shaft 2 or longitudinally move it in the direction facing the edge Aa of the cloth body A fed to the sewing position D.

Said mounting plate 3 is fastened to an edge of the needle plate Ca constituting the sewing machine C, in a way to be movable forward and backward and turning in horizontal direction. It is also all right to fasten the mounting plate 3 directly to the machine base Ce constituting the sewing machine C.

To the guide hole 3*c*, about in the shape of a cross formed on the front end side of the mounting plate 3, is fastened a screw 14, through a guide member 16 to be described later, in a way to be movable in optional direction, while to the guide hole 3*d* about in the shape of the character T formed by its side is fastened a screw 15 in a way to be movable in optional direction.

The screws 14, 15 are fastened to an edge of the needle plate Ca, through the guide holes 3*c*, 3*d*, and fixes the mounting plate 3 to the needle plate Ca, in a way to prohibit movement.

The fastening of the screws 14, 15 is released, to either move the cloth folding guide 1 forward and backward in the direction facing the edge Aa of the cloth body A fed to the sewing position D or turn it horizontally at an angle orthogonal to or intersecting with the edge Aa, so as to fix the belt-shaped cloth B at an angle and a position most suitable for therewith covering the edge Aa of the cloth body A.

Said screw 14 is connected to the guide hole 16 formed in the guide member 16 in a way to be movable forward and backward, and the fastening by the screw 14 is released to move the guide member 16 forward and backward in the direction facing the edge Aa of the cloth body A fed to the sewing position D, and guide the cloth B for therewith covering the edge Aa of the cloth body A.

Figure 4:
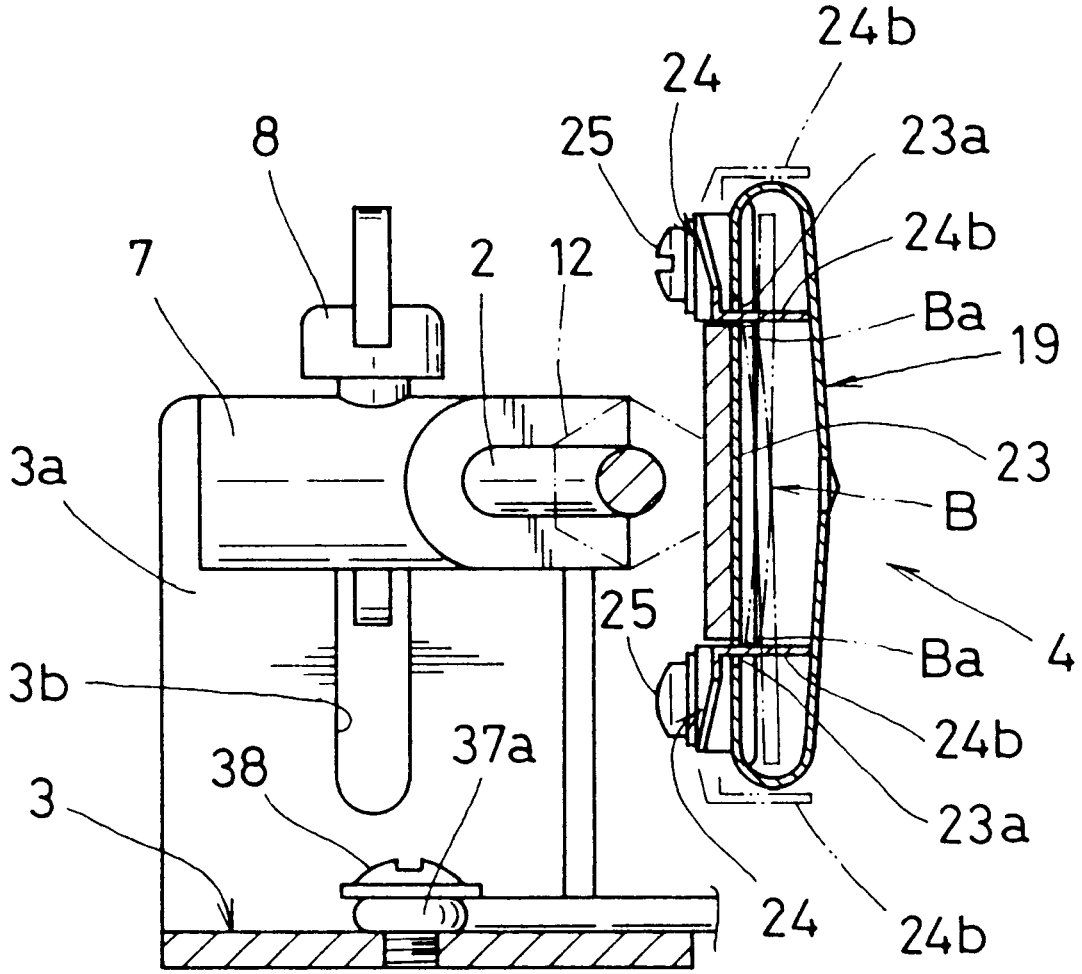
FIG. 4 is a longitudinal sectional view showing the internal structure of the cloth spreading unit.
Figure 5:
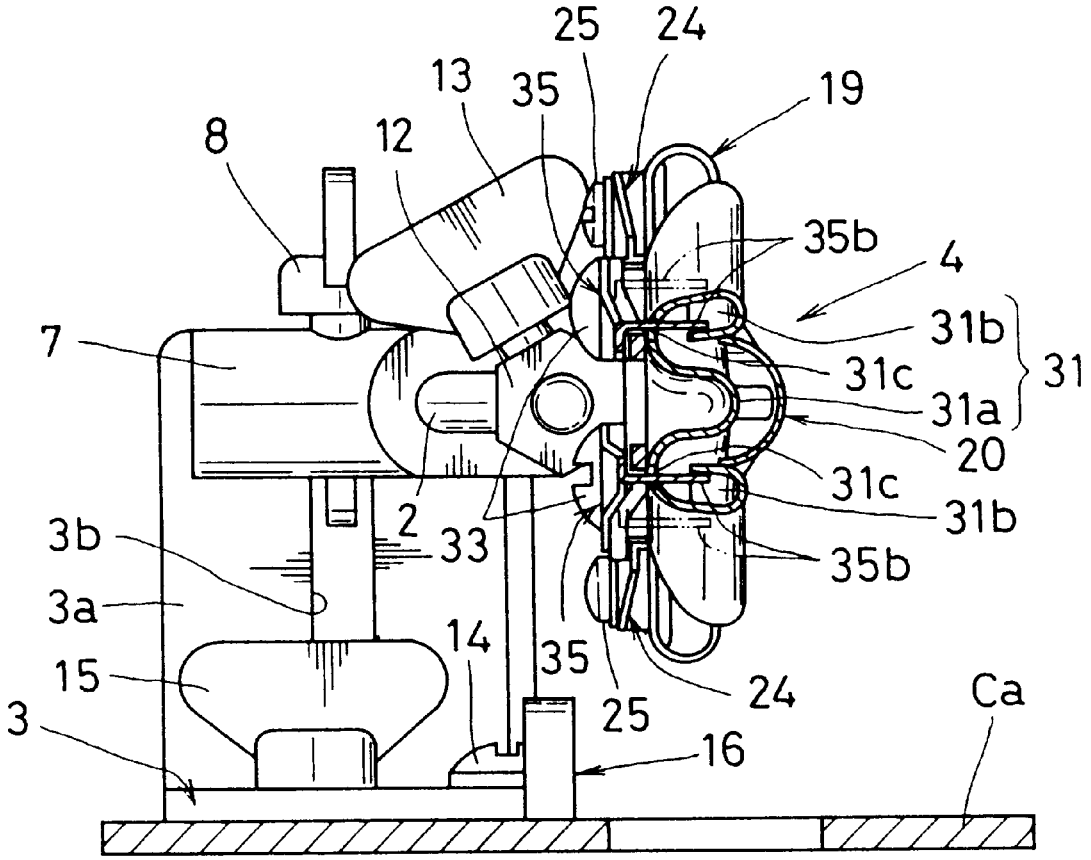
FIG. 5 is a longitudinal sectional view showing the internal structure of the cloth folding unit.
Figure 6:
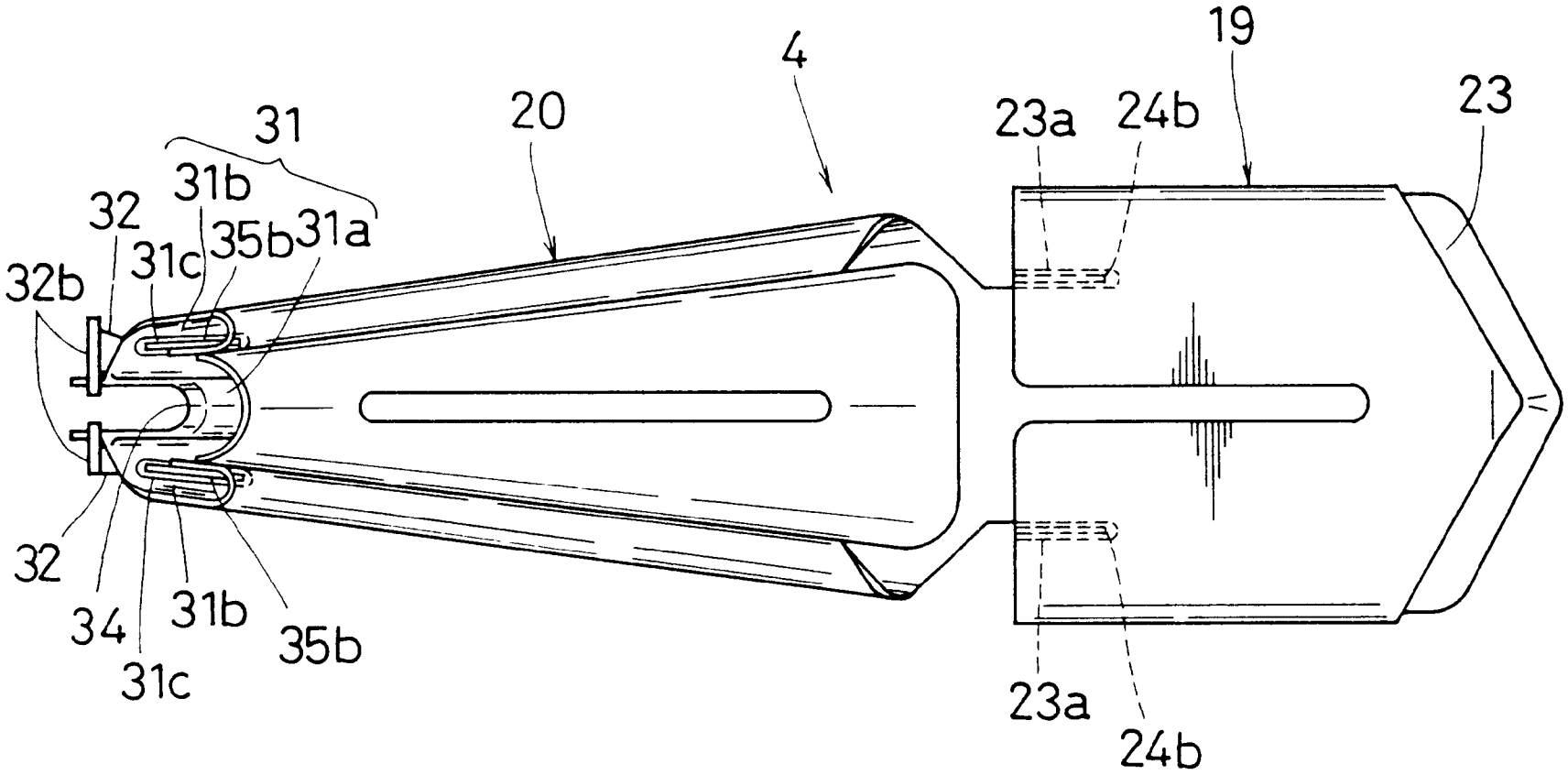
FIG. 6 a plan view showing the state in which the guide body is separated.

Said guide body 4 is provided, as shown also in FIG. 4, FIG. 5, FIG. 6, with a cloth spreading unit 19 for spreading the belt-shaped cloth B in the direction of breadth, and a cloth folding unit 20 for folding the spread cloth B in an optional state of folding (double folding, triple folding, quadruple folding, for example), on the front and rear sides respectively.

The cloth spreading unit 19, having a sectional shape about uniform from the base end side toward the tip end side, is formed in the shape of a flat cylinder in which the cloth B is spread in the direction of breadth.

The front and rear inner wall faces of the flat cylindrical passage 23, formed in the cloth spreading unit 19, are set with an interval in which the spread state of the cloth B is maintained, while the top and bottom inner wall faces are set with an interval wider than the spread width of the cloth B.

At the top and bottom ends on the rear face sides of the cloth spreading unit 19 is a mounted tentering member 24 along the flat cylindrical passage 23.

The screw 25, fastened to the rear face side of the cloth spreading unit 19, is movably connected to the guide hole 24*a* formed on the base end side of the tentering member 24, and fixes the tentering member 24 to the rear face side of the cloth spreading unit 19, in a way to prohibit movement.

The projection 24*b*, formed on the tip side of the tentering member 24, is formed in a size and at an angle (about right angle) to be in contact with the edge Ba of the cloth B inserted in the flat cylindrical passage 23.

The projection 24*b*, fastened to the guide hole 23*a* formed on the rear face on the tip end side of the flat cylindrical passage 23 in a way to make appearances and disappearances and be movable forward and backward, guides the entire cloth B for tentering it to either the top side or bottom side of the flat cylindrical passage 23, to prevent it from being swung in the direction of breadth.

The fastening of the screw 25 is released, to move the tentering member 24 forward and backward and move the projection 24*b* forward and backward along the guide hole 23*a*, so as to fix it to a position where the edge Ba of the cloth B is tentered, or extract (the projection 24*b*) from the guide hole 23*a*.

Said cloth folding unit 20 is formed in a shape which gradually becomes more and more slender from the base end side toward the tip end side, and the opening on the base end side of the folding passage 31 inside is formed in a shape for folding the edges Ba, Ba of the cloth B to the inside, while the opening at its tip end side is formed in a shape for folding the cloth B in about the shape of the character W as seen from the tip end side.

The main passage 31*a*, formed at the center of the folding passage 31, is formed in the shape of a curved face in which the central part of the cloth is curved about in the shape of a mount as seen from the tip end side, while the side passage 31*b*, formed at the top and at the bottom along that main passage 31*a*, is formed at an angle and in a shape allowing the edge Ba of the cloth B to be bent in the direction facing the central part, in such a way that the passages 31*a*, 31*b* gradually increase their amount of curving and bending from the base end side toward the tip end side.

On the rear face side of the cloth folding unit 20 are mounted one upon another a bending member 32 and a control member 35 in a way to be movable forward and backward.

The screw 33 fastened to the rear face side of the cloth folding unit 20, movably connected to the guide hole 32*a* formed on the base end side of the bending member 32 and the guide hole 35*a* formed on the base end side of the control member 35, fixes the bending member 32 and the control member 35 to the rear face side of the cloth folding unit 20, in a way to prohibit movement.

The folding piece 32*b* formed at the tip end of the bending member 32 is formed by bending at about right angle against the edge Ba of the cloth B delivered from the side passage 31*b*.

The folding piece 32*b*, connected to the end part on the projected side of the guide 34 formed at the center on the tip end side of the cloth folding unit 20, guides the edge Ba of the cloth B delivered from the side passage 31*b* at about right angle against the direction parallel to the direction of feed of cloth.

The guide 34, formed by curving in the shape of a smooth concave face against the direction of feed of cloth, guides the cloth B delivered from the bending passage 31 in about the shape of the character U laid on its side.

The projection 35*b*, formed on the tip end side of the control member 35, is formed in a size and at an angle (about right angle) to be in contact with the edge Ba of the cloth B inserted in the side passage 31*b*.

The projection 35*b*, fastened to the guide hole 31*c* formed on the rear face on the tip end side of the side passage 31*b* in a way to make appearances and disappearances and be movable forward and backward, guides the edge Ba of the cloth B in a state controlled on the main passage 31*a* side.

The projection 24*b* of the tentering member 24 and the projection 35*b* of the control member 35 are formed with a thickness enabling their appearances and disappearances as well as forward and backward movements, and in the shape of a smooth curved face (triangle, trapezoid, semi-circle, ellipse, etc., for example) against the direction of insertion of cloth.

The fastening of the screw 33 is released, to move the folding member 32 and/or the control member 35 forward and backward and move the bending piece 32*b* of the bending member 32 in the direction facing the edge Ba of the cloth B delivered from the side passage 31*b*, so as to fix them to the position where the folded state of the cloth B is maintained to therewith cover the edge Aa of the cloth body A.

In addition, the projection 35*b* of the control member 35 is made to move forward and backward along the guide hole 31*c* of the side passage 31*b* to fix it at the position where the edge Ba of the cloth B is controlled to the main passage 31*a* side, or extract (the projection 35*b*) from the guide hole 31*c*.

It is also all right to variably adjust said folding member 32 and control member 35 at optional fixing positions, depending on the thickness, material, state of organization and state of folding of the cloth B, for example.

The cloth guide 37, fixed to the center of the mounting plate 3, is formed in a size and a shape for guiding the cloth B for insertion in the cloth spreading unit 19.

The screw 38, connected to the base end part 37*a* of the cloth guide 37, is fastened to the center of the mounting plate 3, to fix the cloth guide 37 in a state horizontally turned at optional angle.

The stretching portion 37*b*, formed on the free end side, is formed in a shape meandering in up-down direction, and guides the cloth B in the state spread in the direction of breadth.

It is also all right to fix the base end part 37*a* of the cloth guide 37 to the rear face side of the guide body 4, for example, or form the stretching portion 37*b* on the free end side in optional shape such as waveform, ring shape, etc., for example. Moreover, the cloth B may be guided for spreading by using a sheet-like guide, instead of the cloth guide 37.

Fastening members such as machine screws, bolts, pins, etc. may be used in place of said screws 8, 9, 13, 15, 33.

Explanation will be given hereafter on the sewing method adopted for covering the cloth body A along its edge Aa while folding a band-shaped cloth B by means of a cloth folding guide 1 constructed as described above.

First, when sewing the cloth B (width=approx. 28 mm, for example) in the state of quadruple folding, variably adjust the cloth folding guide 1, as shown in FIG. 1, FIG. 2, FIG. 3, in a state to be about orthogonal or at optional angle against the edge Aa of the cloth body A fed to the sewing position D, set it at height, angle and inclination most suitable for covering it with the cloth B, and then release the fastening by screw 25 and extract the projection 24*b* of the tentering member 24 from the guide hole 23*a* of the flat cylindrical passage 23 formed on the cloth spreading unit 19.

Release the fastening by screw 33, and extract the projection 35*b* of the control member 35 from the guide hole 31*c* of the side passage 31*b* formed on the cloth folding unit 20. It is also all right to either insert the projection 35*b* in the guide hole 31*c* on one side, or remove the tentering member 24 and the control member 35.

Next, stretch the cloth B on the stretching unit 37*c* of the cloth guide 37 by spreading it in the direction of breadth, insert it in the flat cylindrical passage 23 of the cloth spreading unit 19, and also insert the cloth B in spread state in the folding passage 31 of the cloth folding unit 20.

Insert the cloth B along the main passage 31*a* and the side passage 31*b* of the folding passage 31, curve the central part of the cloth B inserted in the main passage 31*a* in about the shape of a mountain, fold the edge Ba of the cloth B inserted in the side passage 31*b* in the direction facing the center, and deliver and feed the entire length of the cloth B continuously in the longitudinal direction while folding it into about the shape of the character W laid down on its side as seen from the tip end side.

Since, at the time of folding, the projection 35*b* of the control member 35 is extracted from the guide hole 31*c* of the side passage 31*b*, the edge Ba of the cloth B is bent to inside along the side passage 31*b* without being put in contact with the projection 35*b* of the control member 35.

Figure 7:
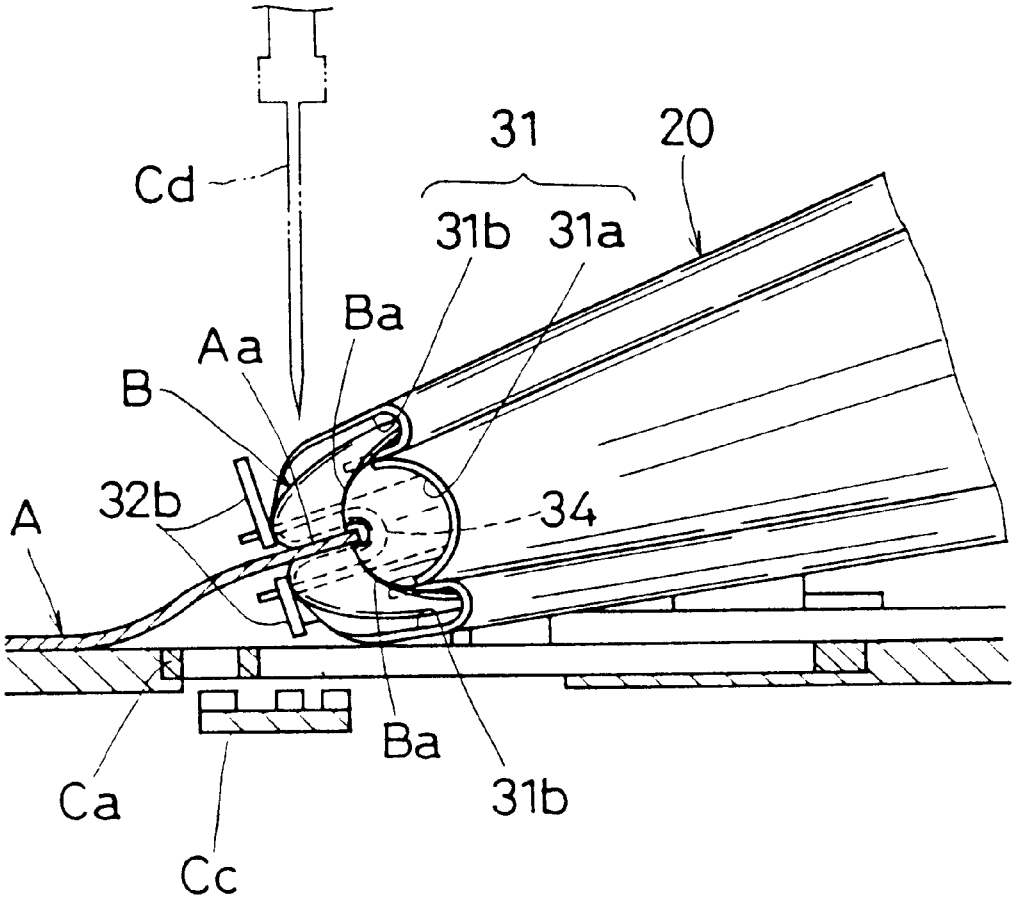
FIG. 7 is a plan view of main part showing the action of covering the cloth in the state of quadruple folding.
Figure 10:
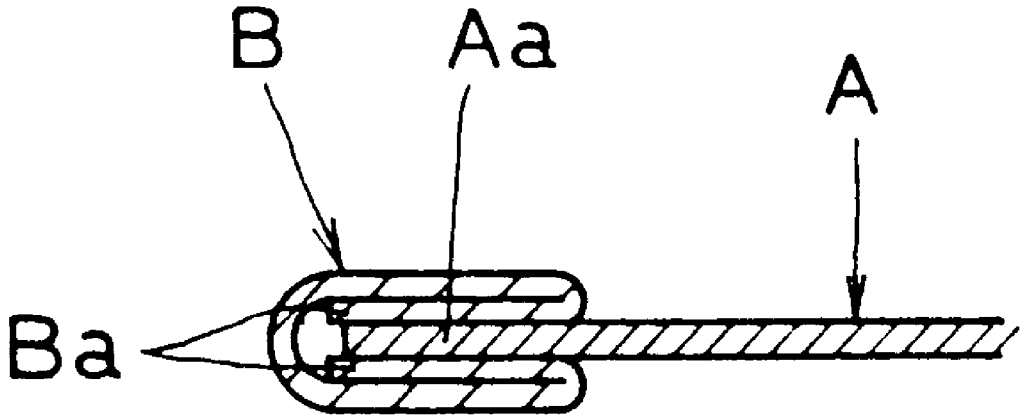
FIG. 10 is a plan view of main part showing an example in which the cloth is covered in the state of quadruple folding.

Next, as shown in FIG. 7, FIG. 10, fold the edges Ba, Ba of the cloth B delivered from the folding passage 31 to the inside, fold the cloth B in the direction about orthogonal to the guide body 4 (direction of feed of cloth), and insert it in the guide 34. At the same time, feed the edge Aa of the cloth body A to about the center of the guide 34.

Put the cloth B in contact with the folding piece 32*a* of the folding member 32, and fold it in the state of quadruple folding as seen from the tip end side to cover the cloth body A along its edge Aa.

On the other hand, as shown in FIG. 2, while covering the cloth B folded in the state of quadruple folding on the edge Aa of the cloth body A, feed the cloth B to the sewing position on the needle plate Ca constituting the sewing machine C, and pinch the cloth B by means of the presser foot Cb and the feed dog Cc while keeping it in the state covering the edge Aa of the cloth body A.

Drive the sewing machine C and, with the up-down motion of the presser foot Cb and the feed motion of the feed dog Cc, transfer the cloth B in the state of quadruple folding to the direction of feed of cloth (direction of arrow mark) while keeping it in the state covering the edge Aa of the cloth body A. In linkage with that feed motion, make the needle Cd up and down, to sew the cloth B along the edge Aa of the cloth body A.

Figure 8:
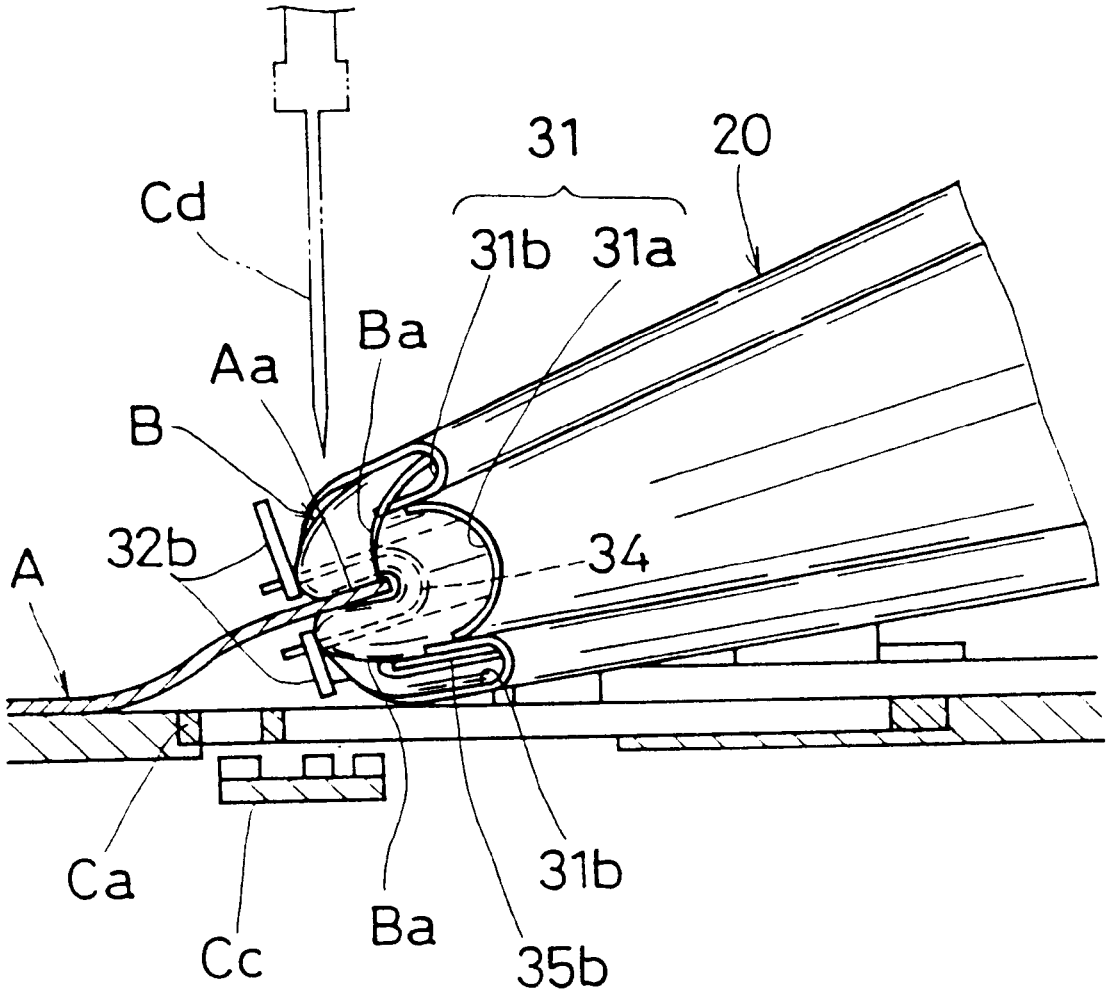
FIG. 8 is a plan view of main part showing the action of covering the cloth in the state of triple folding.
Figure 11:
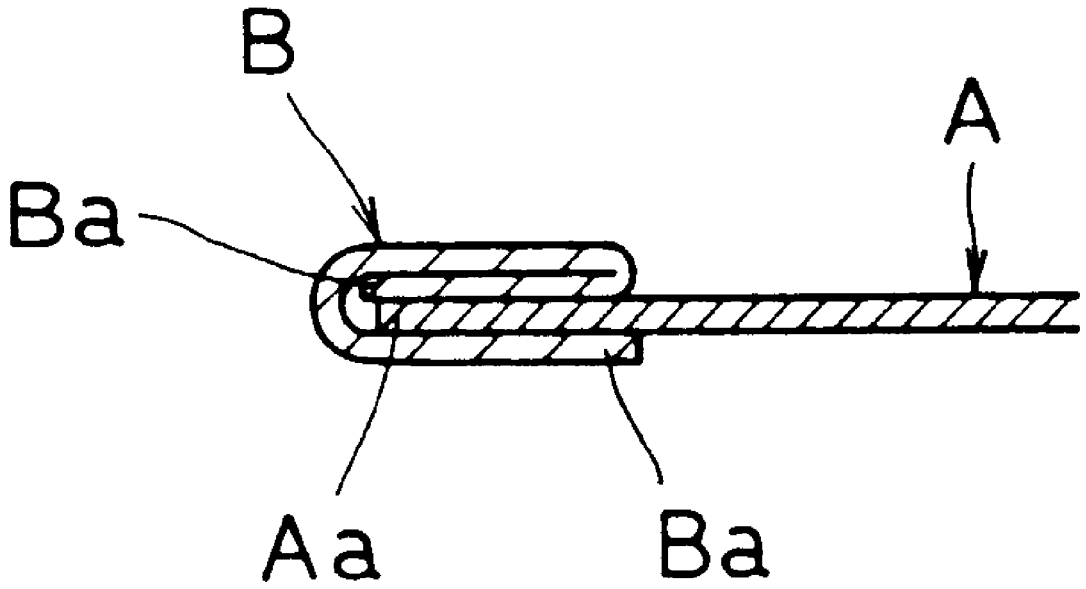
FIG. 11 is a plan view of main part showing an example in which the cloth is covered in the state of triple folding.

Next, when sewing the cloth B (width=approx. 24 mm, for example) into the state of triple folding, insert the projection 35*b* of the lower control member 35 in the guide hole 31*c* of the lower side passage 31*b* formed in the cloth folding unit 20, as shown in FIG. 8, FIG. 11, to prevent folding of the lower edge Ba of the cloth B with the projection 35*b* of the control member 35.

On the other hand, extract the projection 35*b* of the upper control member 35 from the guide hole 31*c* of the upper side passage 31*b* and fold the upper edge Ba of the cloth B to inside along the side passage 31*b*. This makes it possible, in the same way as above, to sew the cloth B along the edge Aa of the cloth body A while folding it into a state of triple folding.

When the projection 35*b* of the upper control member 35 is inserted in the guide hole 31*c* of the upper side passage 31*b*, folding of the upper edge Ba of the cloth B is prevented by the projection 35*b*, making it possible to fold the lower edge Ba of the cloth B to inside.

At the time of folding, insert the projection 24*b* of the upper tentering member 24, as shown in FIG. 4, in the upper guide hole 23*a* of the flat cylindrical passage 23 formed in the cloth spreading unit 19, and put the upper edge Ba of the cloth B in contact with the projection 24*b* of the tentering member 24 to stretch the entire cloth B to the lower side passage 31*b*. This makes it possible to prevent narrowing of the folding width of the upper edge Ba of the cloth B or swing in the direction of breadth of the cloth B.

When the projection 24*b* of the lower tentering member 24 is inserted in the lower guide hole 23*a* of the flat cylindrical passage 23, the entire cloth B is tentered to the upper side passage 31*b*, making it possible to narrow the folding width of the lower edge Ba of the cloth B. On the contrary, the folding width can be increased when the projection 24*b* is extracted.

Figure 9:
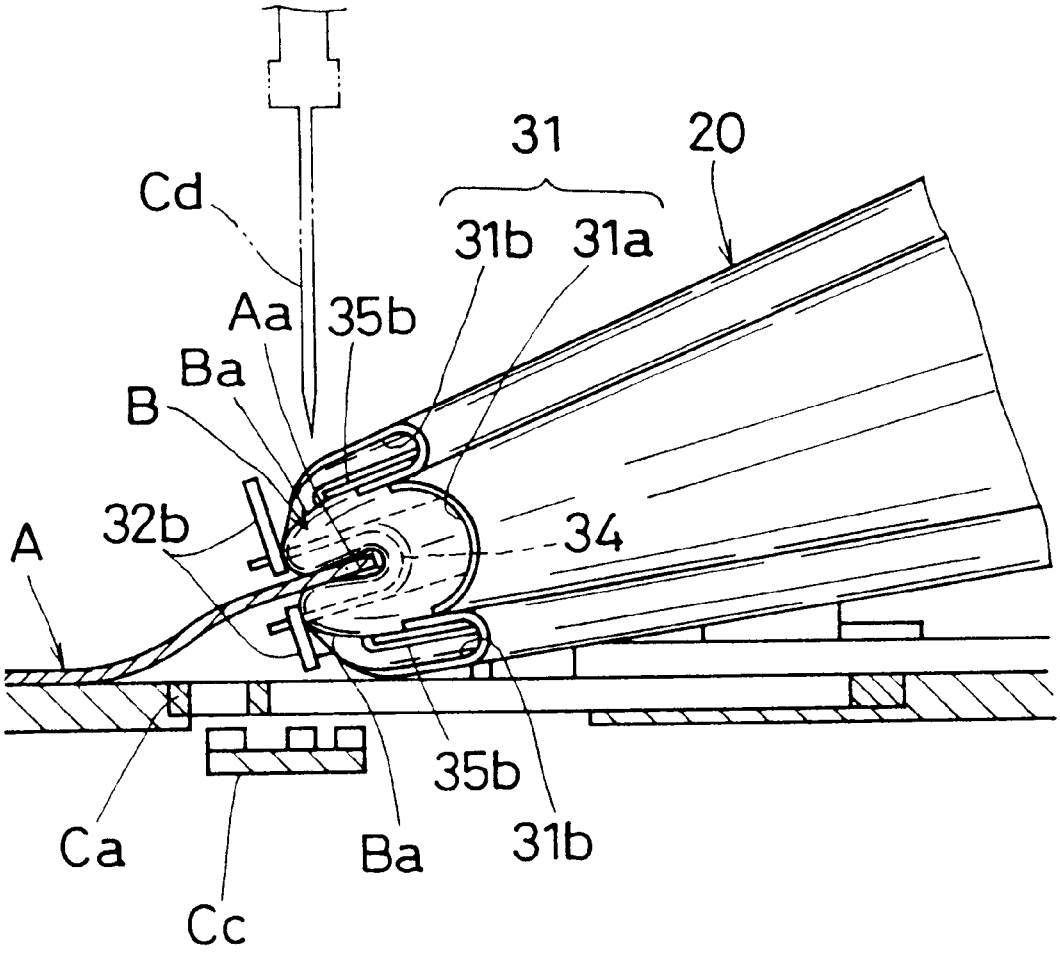
FIG. 9 is a plan view of main part showing the action of covering the cloth in the state of double folding.
Figure 12:
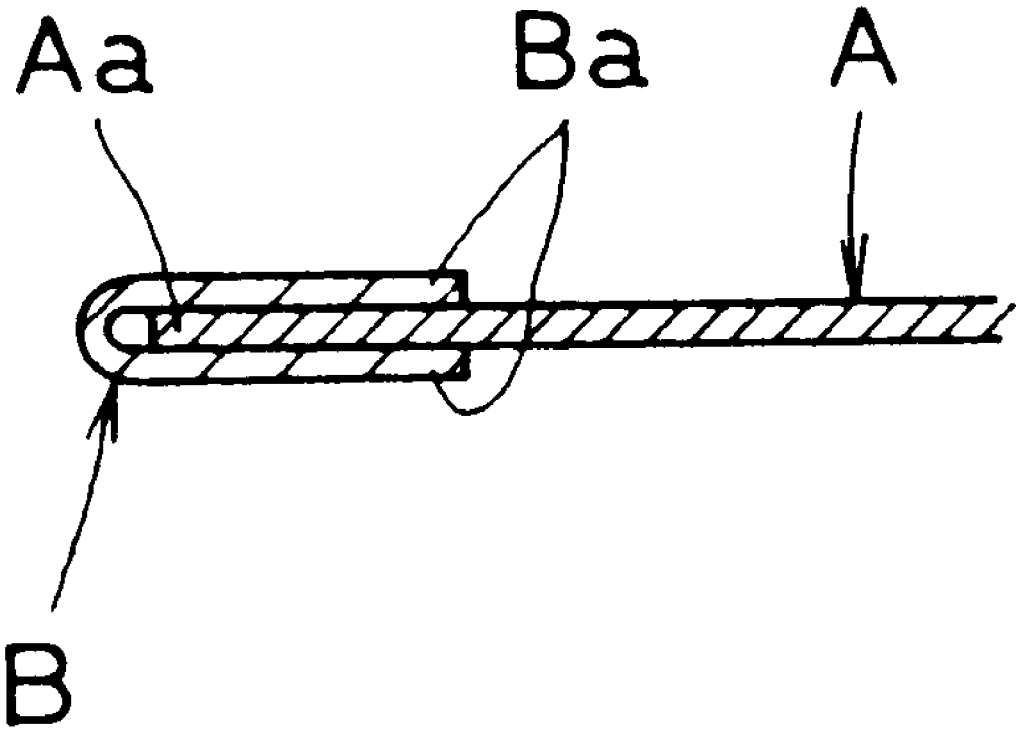
FIG. 12 is a plan view of main part showing an example in which the cloth is covered in the state of double folding.

Next, when sewing the cloth B (width=approx. 24 mm, for example) into the state of double folding, insert the projection 35*b* of the upper & lower control members 35 in the guide hole 31*c* of the upper & lower side passages 31*b* formed in the cloth folding unit 20, as shown in FIG. 9, FIG. 12, to prevent folding of the edge Ba, Ba of the cloth B with the projection 35*b* of the upper & lower control members 35. This makes it possible to sew the cloth B into a state covering the edge Aa of the cloth body A while folding it into a state of double folding.

As described above, the control member 35 works to either prevent folding of the edge Ba of the cloth B or cancels this prevention of folding, thus making it possible to not only fold the cloth B in optional state of folding and sew it neatly with a good finish after sewing but also perform the sewing into a state covering the edge Aa of the cloth body A stably and smoothly.

Moreover, since the cloth B can be folded in optional state of folding with a single cloth folding guide 1, there is no need of either manufacturing or preparing special folding guides as in the prior art and this saves time and labour for replacing the guides, thus shortening the working time to change to optional folding state, to not only improve the working efficiency of sewing but also reduce the sewing cost.

Furthermore, since the cloth B is guided for tentering with the tentering member 24, it becomes possible to perform the operations for either folding the edge Ba of the cloth B at optional width or changing that folding width accurately and easily, thus finishing the sewing in desired state of folding without swing in direction of breadth of the cloth B.

Still more, it is possible to variably adjust the guide body 4 to optional height, position and angle suitable for covering with cloth B, by either moving it in horizontal direction or vertical direction or turning in up-down direction or left-right direction.

In the correspondence between the construction of the present invention and the embodiment described above, the folding preventing means of the present invention corresponds to the control member 35 in the embodiment, while the folding width changing means corresponds to the tentering member 24.

I claim:

1. A cloth folding guide for sewing machine for guiding a belt-shaped cloth to fold it into a state in which the edge of the cloth body is covered, in the sewing by sewing machine, comprising a cloth folding unit for folding and guiding said cloth in the direction of breadth, and, in said cloth folding unit, a folding preventing means for preventing one side edge or both side edges of said cloth from being folded in the direction of breadth.

2. A cloth folding guide for sewing machine as defined in claim 1, wherein at the end part of said cloth folding unit is provided a cloth spreading unit for feeding said cloth by spreading it in the direction of breadth to the cloth folding unit, while said cloth folding unit and/or cloth spreading unit comprise a folding width changing means for changing the folding width of said cloth.

3. A cloth folding guide for sewing machine as defined in claim 1, wherein said folding preventing means comprises a control member facing the edge part of the cloth fed to said cloth folding unit, while said control member is movably provided at a position to be in contact with the edge part of said cloth and a position to avoid that contact.

4. A cloth folding guide for sewing machine as defined in claim 1, wherein said folding width changing means comprises a tentering member facing the edge part of the cloth fed to said cloth spreading unit, while said tentering member is movably provided at a position to be in contact with the edge part of said cloth and a position to avoid that contact.

5. A cloth folding guide for sewing machine as defined in claim 1, wherein said cloth folding unit is provided to be movable in horizontal direction and/or vertical direction.

6. A cloth folding guide for sewing machine as defined in claim 1, wherein said cloth folding unit is provided to be turnable in horizontal direction and/or vertical direction.

* * * * *